United States Patent [19]

Madsen

[11] 4,091,994

[45] May 30, 1978

[54] HEAT PUMP DEVICE

[75] Inventor: Henning Brinch Madsen, Greve Strand, Denmark

[73] Assignee: Svenska Geotherm Aktiebolag, Karlstad, Sweden

[21] Appl. No.: 664,027

[22] Filed: Mar. 4, 1976

[30] Foreign Application Priority Data

Mar. 10, 1975 Denmark ..... 949/75

[51] Int. Cl.[2] ..... G05D 23/00; F25B 27/02

[52] U.S. Cl. ..... 237/2 B; 62/238

[58] Field of Search ..... 61/160, 238; 237/2 B; 165/18, 28, 29

[56] References Cited

U.S. PATENT DOCUMENTS

| | | | |
|---|---|---|---|
| 2,060,636 | 11/1936 | Persons | 165/18 |
| 2,266,238 | 12/1941 | Newton | 237/2 |
| 2,751,761 | 6/1956 | Borgend | 62/238 |
| 2,780,415 | 2/1957 | Gay | 237/2 |
| 2,860,493 | 11/1958 | Capps et al. | 62/238 |
| 3,188,829 | 6/1965 | Siewert et al. | 62/238 |
| 3,548,923 | 12/1970 | Nakano et al. | 165/18 |
| 3,916,638 | 11/1975 | Schmidt | 62/238 |
| 3,959,986 | 6/1976 | Ledermann | 62/160 |

*Primary Examiner*—Lloyd L. King

*Attorney, Agent, or Firm*—Larson, Taylor and Hinds

[57] ABSTRACT

A heat pump for simultaneous heating of hot water for consumption and water for heating radiators comprising besides the heat pump in itself a water reservoir heated by the condenser of the heat pump. The water reservoir is enclosed by a fluid holding cover which forms a part of the heating radiator system. Means are provided for regulating the part of the water of the heating system that passes through the cover and the part of the water that passes through a by-pass branch around said cover. The relation between said two parts may be thermostatically regulated.

3 Claims, 2 Drawing Figures

HEAT PUMP DEVICE

FIELD OF THE INVENTION

The present invention relates to a heating device for simultaneous heating of water for heating radiators and hot consumption water, comprising a heat pump and a water receptacle heated by the heat pump.

BACKGROUND OF THE INVENTION

It is well known to use a heat pump in order to utilize the heat energy stored in a heat reservoir, for instance in the earth surface. Due to the fact that it is very difficult to regulate the capacity of a compressor, the known device has the drawback that the compressor rather quickly after the start is adjusted to a certain temperature of condensation and compression independent of the demand for heating, such that the efficiency factor, i.e. the relation between the total heating effect and the consumed effect for the operation of the compressor does not become optimal.

SUMMARY OF THE INVENTION

The object of the present invention is the provision of a heating device with a heat pump for simultaneous heating of water for heating radiators and hot consumption water, which device is so arranged that the highest possible efficiency factor is obtained.

A further object of the invention is to make use of the accumulating property of the hot water receptacle so that the operation time of the compressor will be equalized and the temperature of the cooling medium of the heat pump will not be able to rise substantially over the temperature of the hot water.

Another object of the invention is to utilize the inherent heat of the cooling medium condensate before the condensate vaporizes at the expansion valve.

BRIEF DESCRIPTION OF THE DRAWINGS

The invention will be further described with reference to the following description of one embodiment and with reference to the drawings, where FIG. 1 shows a vertical section through one embodiment of the heat pump device according to the invention, while

DESCRIPTION OF THE PREFERRED EMBODIMENT

Figure 1:
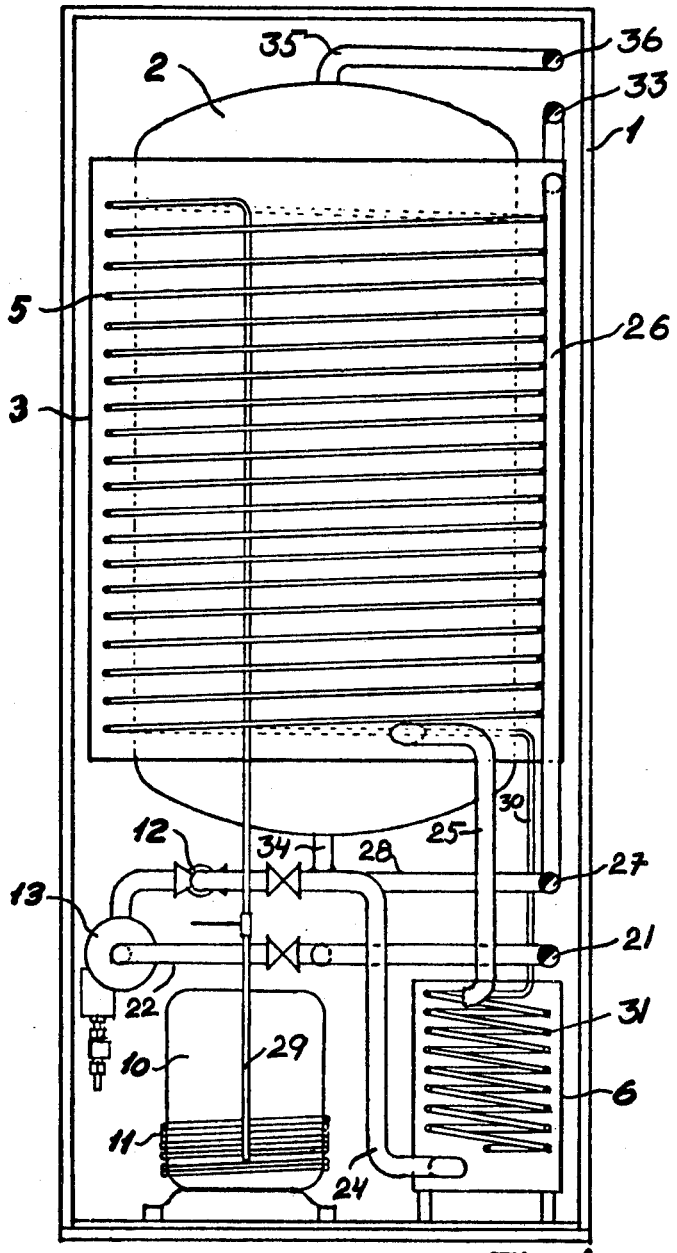
Figure 2:
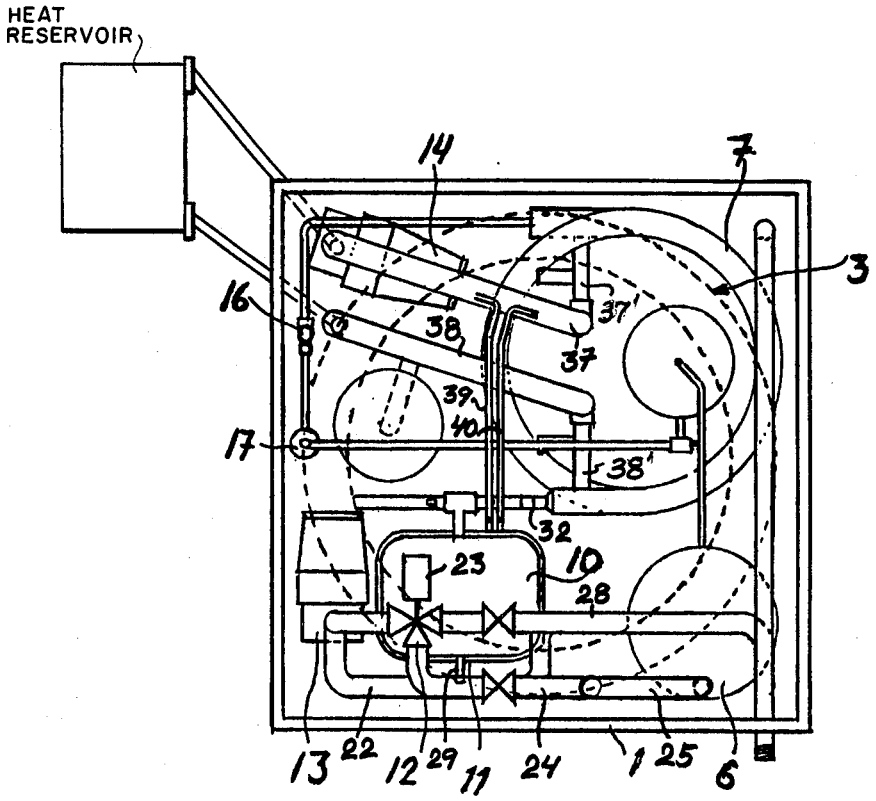
FIG. 2 shows a horizontal section through the device shown in FIG. 1.

The heat pump device according to the invention is mounted inside a heat insulating housing 1 and comprises a hot water receptacle 2 which has a cover 3 filled with water, in which there is disposed a helical copper pipe 5 which forms the predominant part of the condenser of the heat pump. The heat pump comprises a compressor 10, a vaporizer disposed in a heat exchanger 7, a thermostatic expansion valve 16 and a drying filter 17. The part of the condenser which is not disposed inside the water holding cover 3 is disposed in a heat exchanger 6, the function of which will be described below.

By means of the heat exchanger 7 the vaporizer of the heat pump is in heat transferring connection with a a brine device, i.e. a device comprising a circulating fluid, the freezing point of which is below 0° C. The fluid in the brine device receives heat energy for instance from the earth surface or from the surrounding air (as diagrammatically shown), which heat energy is delivered in the heat exchanger 7, when the cooling medium in the heat pump vaporizes. The brine device comprises a circulation pump 14, which is mounted so that the brine fluid flows from the circulation pump 14 through tubes 37 and 37' to the heat exchanger 7, and therefrom through tubes 38 and 38'. Then the heat generated by the circulation pump is utilized, and for further increasing the temperature of the brine fluid a helical copper tube 11 is wound about the lower part of the compressor 10. In accordance with the invention the ends of this tube are disposed in the brine fluid between the circulation pump 14 and the heat exchanger 7 so that the open ends of the tube are directed in the flow direction of the brine and in the reverse direction, respectively.

As mentioned above, the water receptacle 2 which holds the hot water is in heat transferring connection with a hollow cover 3 which encloses the water receptacle and in which the predominant part of the condenser of the heat pump is arranged. At the condensation of the cooling medium heat energy is delivered to the fluid flowing through the cover 3 and heat energy is also delivered to the water in the receptacle 2. The receptacle 2 has a volume of at least 300 liters and in this way it forms a heat accumulating means for equalizing the operational time of the compressor.

By means of a circulation pump 13 the fluid in the cover 3 is circulated through a heating radiator system, a system for floor heating or the like. Since the temperature of the circulating return fluid, for instance from the heating radiators is lower, in the order of 10° C, than the temperature of the supply water, the return fluid is directed through the heat exchanger 6 for further cooling of the cooling medium condensate, the temperature of which is substantially the same as the temperature at the bottom of the cover 3. In this way a smaller medium pressure of the cooling medium through the condenser is obtained and in this way the efficiency factor is increased. The fluid flow is supplied to the heat exchanger 6 and to the cover 3 in such a way that the fluid rotates, whereby the transmission factor is increased.

The radiator water from the heating radiator system is supplied to an inlet 21 and passes through the conduit 22 to the circulation pump 13. From this pump the radiator water is transferred to the three-way valve 12, which is controlled by the motor 23. One output conduit 24 from the valve 12 brings the radiator water to the heat exchanger 6 and after it has been warmed up therein, it passes through the conduit 25 to the interior of the cover 3. From this cover the heated radiator water is transferred through the conduit 26 to an outlet 27 and then from there to the heating radiator system. Finally a by-pass conduit 28 directly connects a second output from the valve 12 with the outlet 27. The heat pump medium is conducted from the compressor 10 through the conduit 29 to the helical copper tube 5 and then from there through the conduit 30 to a helical tube 31 in the heat exchanger 6. Then the heat pump medium is conducted to the drying filter 17, the expansion valve 16 and from there to the heat exchanger 7 to pass in heat exchange relationship with the brine. Finally, the heat pump medium is returned to the compressor 10 through the conduit 32.

The water to be heated in the water receptacle passes from a connection 33 through a conduit 34 to the bottom of the water receptacle 2. The heated water is obtained at the top of the water receptacle 2 and reaches an outlet 36 for hot water through a conduit 35.

The heat medium (brine) from the heat reservoir is supplied through the conduit 37 and tube 37' to the heat exchanger 7 by means of the circulation pump. From the heat exchanger 7 the heat medium is returned to the heat reservoir through the tube 38' and conduit 38. The helical copper tube 11 is connected with two tubes 39 and 40 which extend into the conduit 37, whereby, as described above, the open ends of the helical tube 11 are directed in the same and in the opposite direction as the current in the conduit 37, respectively.

In accordance with the invention the temperature of the device is controlled in a manner which is very advantageous for heat pumps. The temperature of the supply water for the heating radiators for instance should be as low as possible in order to meet the heat requirements of the house. This is achieved by means of a motor-controlled three-way valve 12, by means of which a certain amount of the return fluid can be directed in a path parallel to the cover 3 and directly to the supply conduit. The motor of the three-way valve is controlled according to the invention by means of a thermostat mounted in a room or outside the house, while the operational periods of the compressor 10 are governed by means of a thermostat mounted inside the cover 3. When the device is controlled in this manner, the heat accumulating properties of the hot water receptacle 2 are utilized in the best possible way.

I claim:

1. Heating device for simultaneous heating of water for heating radiators and hot consumption water comprising a heat pump, including a compressor, a vaporizer, a condenser and a thermostatic expansion valve connected in a closed circuit; a hot water receptacle for the hot consumption water and having inlet and outlet means for said consumption water; a cover surrounding the hot water receptacle and forming therewith a surrounding separate space wherein said condenser is disposed; means including a supply conduit and a return conduit for passing the radiator water through said space; a by-pass conduit from the supply circuit to the return conduit outside the cover; and control means for passing an adjustable amount of radiator water through said by-pass conduit.

2. Heating device according to claim 1, wherein said control means comprises a three-way valve controlled by a motor.

3. Heating device according to claim 1 and further comprising a heat exchanger for heat exchange from a heat carrying medium of the heat pump leaving the condenser and to the radiator water before the entrance thereof into the space formed with said receptacle by said cover.

* * * * *